United States Patent [19]

Yu-Tseng

[11] Patent Number: 5,040,761

[45] Date of Patent: Aug. 20, 1991

[54] HANDY ADJUSTING ASSEMBLY FOR DISPOSABLE CUP HOLDER

[76] Inventor: Hsu Yu-Tseng, 5F-3, No. 36 Hsining S. Rd., Taipei, Taiwan

[21] Appl. No.: 591,077

[22] Filed: Oct. 1, 1990

[51] Int. Cl.[5] ..... A47K 7/00

[52] U.S. Cl. ..... 248/311.2; 220/85 H; 221/304

[58] Field of Search ..... 248/149, 154, 311.2, 248/314, 313, 316.1, 316.2; 221/304, 303, 307, 310; 220/85 H, 96

[56] References Cited

U.S. PATENT DOCUMENTS

| | | | |
|---|---|---|---|
| 2,315,827 | 4/1943 | Tansley | 221/304 |
| 2,365,916 | 12/1944 | Terry et al. | 221/303 |
| 3,163,323 | 12/1964 | Behrens et al. | 221/304 X |
| 3,581,934 | 6/1971 | Sciascia | 221/304 |
| 3,790,023 | 2/1974 | Filipowicz | 221/304 |
| 4,234,101 | 11/1980 | Pastore | 221/304 X |
| 4,319,696 | 3/1982 | Stevens | 221/310 |

*Primary Examiner*—David L. Talbott

*Attorney, Agent, or Firm*—Notaro & Michalos

[57] ABSTRACT

A handy adjusting assembly for disposable cup holder, including a cup sleeve for containing disposable cups; a sleeve connector screwed on lower end of the cup sleeve, lower end of the sleeve connector being formed with an outward extending cover shade, an inner surface of upper end of the cover shade being formed with a stopper portion; an adjusting ring screwed on the lower end of the sleeve connector and being provided with a plurality of support seats each of which is formed with a strip hold; and a plurality of support strips extending through the strip holes of the support seats to hang thereon, upper portion of each of the support strips extending outside the adjusting ring and lower portion thereof extending inside the adjusting ring, upper end of the support strip abutting against the stopper portion of the sleeve connector whereby by means of adjusting the height of the adjusting ring, lower ends of the support strips can be moved inward and outward to hold various disposable cups with different sizes.

3 Claims, 4 Drawing Sheets

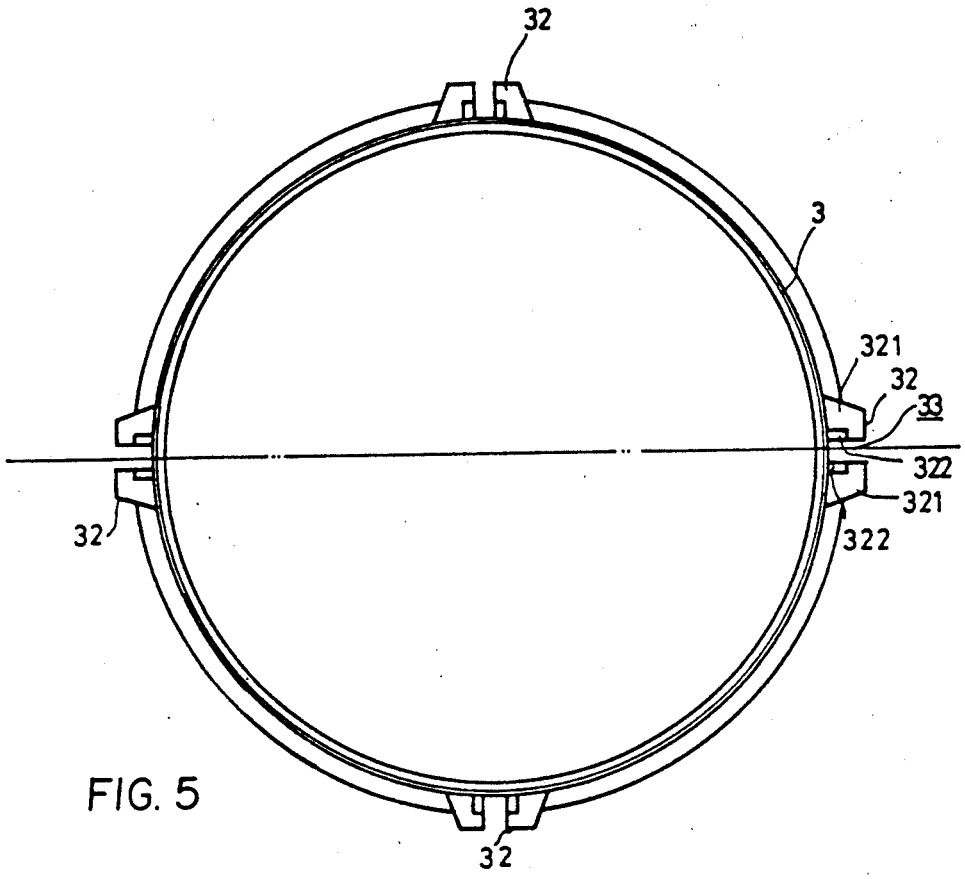
FIG. 5
FIG. 4
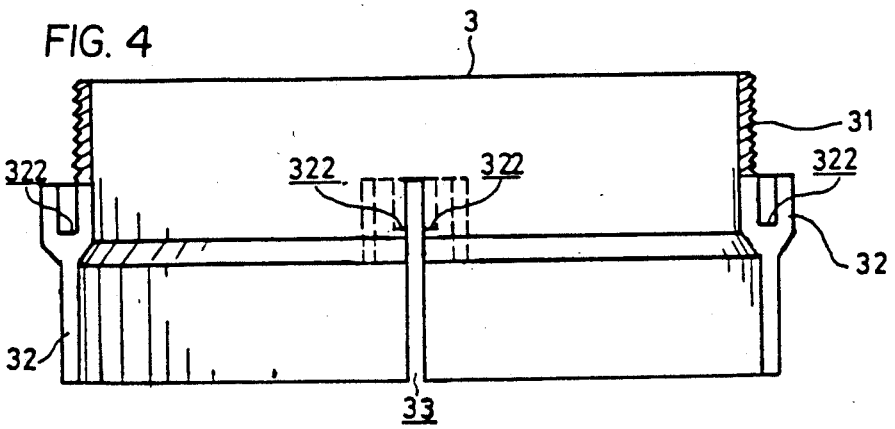

HANDY ADJUSTING ASSEMBLY FOR DISPOSABLE CUP HOLDER

BACKGROUND OF THE INVENTION

The present invention relates to a handy adjusting assembly for a disposable cup holder, and more particularly to an adjusting assembly capable of adjusting the specification of a disposable cup holder, enabling the same to hold various disposable cups having different sizes.

Presently, disposable cups are widely used on various occasions to achieve the objects of convenience and hygiene. The disposable cups are previously placed in a cup holder therefor whereby when required, one only needs to draw out the disposable cups from the cup holder. However, various types of disposable cups with different sizes are available presently so that if a cup holder is only suitable for holding one specific type of disposable cups, the user is inconvenienced. Therefore, an adjustable disposable cup holder is required to contain different disposable cups with different specifications.

In a typical design related to an adjustable disposable cup holder, a hollow shaft body is provided with several clamp strips. A hoop is screwed on the clamp strips so that the more the hoop is screwed upward, the more the clamp strips are inwardly biased. By means of adjusting the inner diameter of a circle formed by the clamp strips; different disposable cups with various specifications can be held in the cup holder. However, some drawbacks are found in such adjustable cup holder as follows:

1. The hoop is disposed inside a cup supporting sleeve so that when adjusting the inner diameter of the clamp strips, the hollow shaft body and the hoop must be taken out for adjustment and again placed into the cup supporting sleeve after adjustment such a procedure is troublesome.

2. The hollow shaft body and hoop are both made of plastic so that elasticity failure of the clamp strips take place easily. Moreover, the clamp strips are apt to be displaced inwardly, making the screw connection between the hoop and clamp strips unstable. Consequently, the hoop is easy to detach from the clamp strips and often a series of disposable cups drop down when they are to be used.

3. The width of the clamp strip is not sufficiently large and the elasticity of the plastic strips is poor so that the lower end of the clamp strip must be formed with a sharp projection to hold the disposable cups. Therefore, when removing a disposable cup, the upper edge thereof is frequently damaged and forms a coarse edge which can injure a user's lip.

The inventor has therefore tried to develop a handy adjusting assembly a disposable cup holder to eliminate the above-mentioned shortcomings existing in the prior art.

SUMMARY OF THE INVENTION

It is a primary object of this invention to provide a handy adjusting assembly for a disposable cup holder, including a cup sleeve, a sleeve connector screwed on a lower end thereof, and several support strips going through the adjusting ring. Whereby by means of a lifting/lowering of the adjusting ring, the abutting angle of the upper ends of the support strips against the sleeve connector is varied to adjust the inner diameter of a circle formed by lower ends of the support strips to suit different disposable cups with various specifications.

It is a further object of this invention to provide the above adjusting assembly wherein the lower end of the support strip is formed with a round abutting block to hold the upper edge of a disposable cup, permitting the cup to be smoothly drawn out without damage.

BRIEF DESCRIPTION OF THE DRAWINGS

The present invention can be best understood through the following description and accompanying drawings. However, it is to be understood that the form of the invention shown and disclosed is to be taken as a preferred embodiment of the invention and that various changes in the shape, size, and arrangement of parts may be resorted to without departing from the spirit of the invention or the scope of the subjoined claims.

FIG. 4 is a sectional view of the adjusting ring of the invention; and

FIG. 5 is a top plan view of FIG. 4.

DETAILED DESCRIPTION OF THE PREFERRED EMBODIMENT

Figure 1:
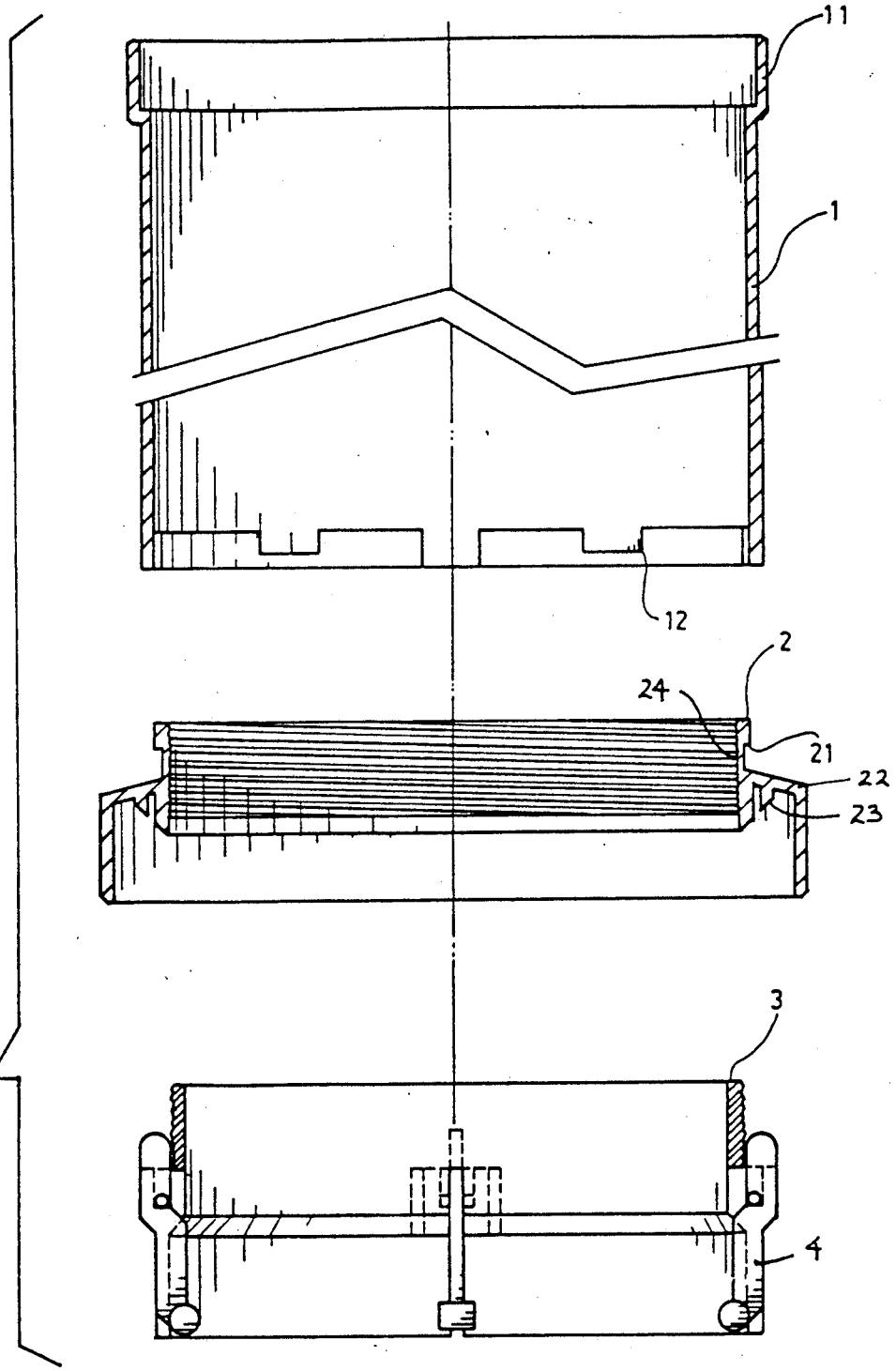
FIG. 1 is an exploded sectional view of the invention.
Figure 2:
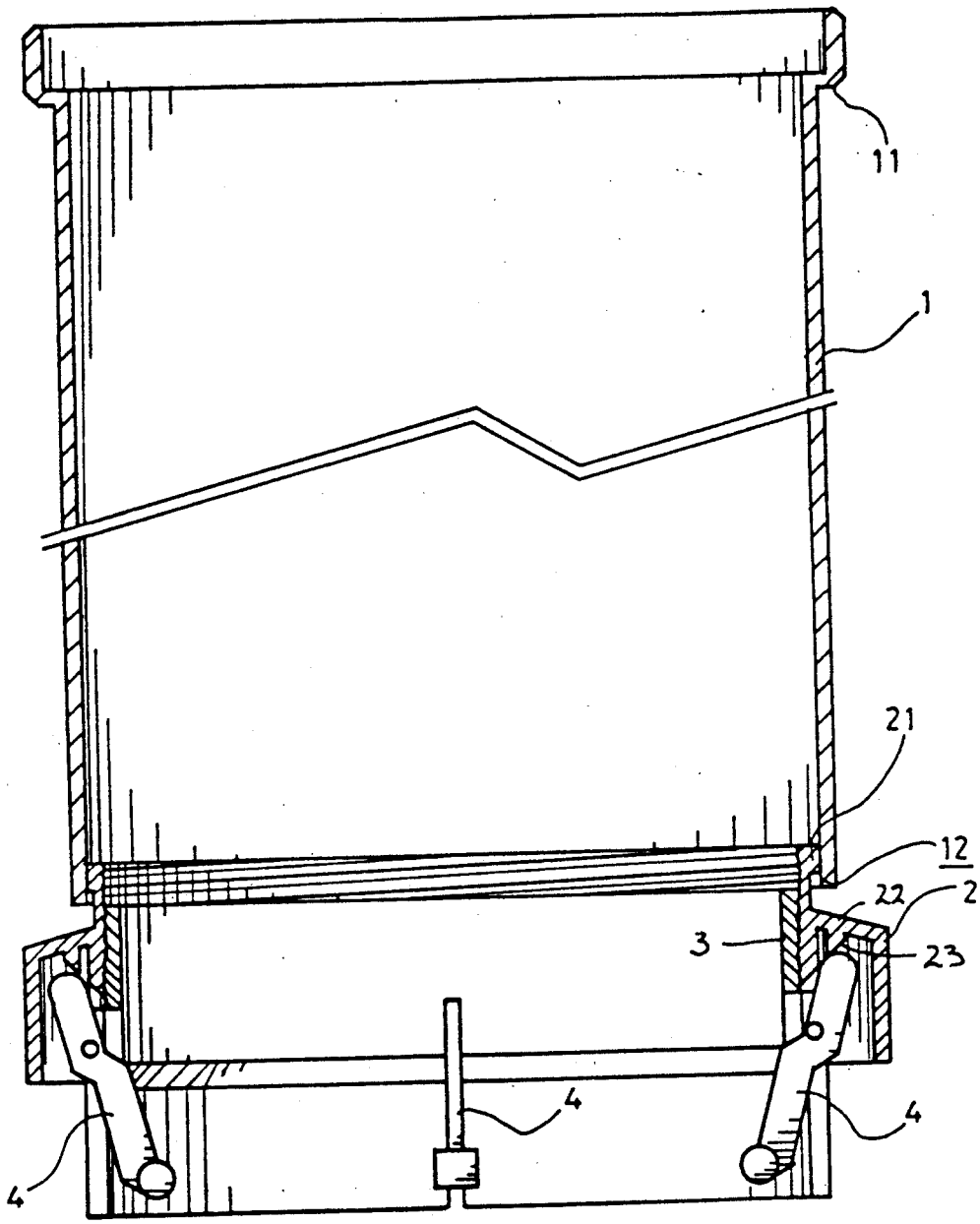
FIG. 2 is an assembled sectional view of the invention.

Please first refer to FIGS. 1 and 2. The adjusting assembly for a disposable cup holder of this invention includes a cup sleeve 1, a sleeve connector 2 attached on lower end of the cup sleeve 1, an adjusting ring 3 screwed onto a lower end of the sleeve connector 2, and several support strips 4. At upper end of the cup sleeve 1 is a cup holder (not shown). An engaging groove 12 is formed at the lower end of the cup sleeve 1 with which a projection 21, formed at the upper end of the sleeve connector 2, is engaged. An outwardly extending cover shade 22 is disposed at the lower end of the sleeve connector 2 and a slant stopper portion 23 is formed on an inner surface of an upper end of the cover shade 22. Inner threads 24 are formed at the lower end of the sleeve connector 2 for the adjusting ring 3 to screw thereon.

Figure 3:
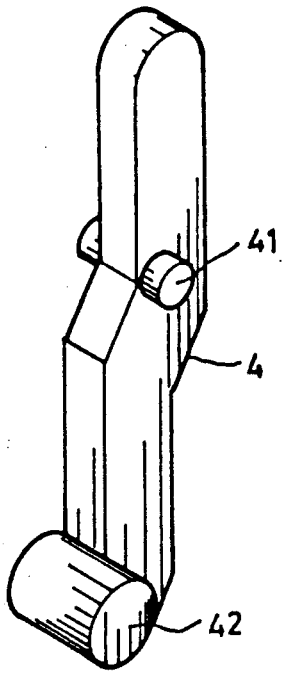
FIG. 3 is a perspective view of the support strip of the invention.

Please now refer to FIGS. 3 to 5, where an upper end of the adjusting ring 3 is shown formed with outer threads 31 to screw on the lower end of the sleeve connector 2. Multiple support seats 32 are disposed on the adjusting ring 3. Each support seat 32 includes a pair of support legs 321 between which a slot 33 is formed. Each support leg 321 is formed with a recess 322, whereby the support strip 4 can be extended through the slot 33 to hang in the recess 322 of the support seat 32. As shown in FIG. 3, the support strip 4 is slightly angled and formed with central projecting pin 41 for hanging in the recess 322 of the support seat 32. A round abutting block 42 is formed at a lower end of the support strip 4 to hold a disposable cup. The upper end of the support strip 4 is smoothly arch-shaped. When the support strip 4 is hung on the adjusting ring 3, the central projecting pin 41 of the support strip 4 is located in the recess 322 with the upper portion of the support strip 4 extending outside the adjusting ring 3 and the lower portion thereof extending inside the adjusting ring 3, whereby when the adjusting ring 3 is screwed onto the sleeve connector 2, the upper end of the support strip 4 will abut against the stopper portion 23 and the more the adjusting ring 3 is lifted, the more the support strip 4 is accordingly inclined, i.e., the lower abutting block 42 thereof is moved inwardly to reduce the inner diameter of a circle formed by all abutting blocks of the support strips 4.

According to the above arrangement, by means of lifting and lowering the adjusting ring 3, the abutting blocks 42 can be moved inwardly and outwardly to adjust the distance therebetween so that various disposable cups with different sizes can be held thereby. The support seat 32 extends downwardly by a selected distance so that the adjusting ring 3 can be conveniently adjusted without removing it from the assembly. Moreover, the support strips 4 are hung on the adjusting ring 3 to abut against and hold a disposable cup at different inclined angles so that the drawbacks of elasticity failure can be eliminated. In addition, the upper edge of a disposable cup is clamped by the round abutting blocks of the support strips 4 so as to avoid damaging the cup when it is drawn out of the holder.

I claim :

1. A handy adjusting assembly for a disposable cup holder, comprising:

a cup sleeve for containing a disposable cup;

a sleeve connector attached to a lower end of said cup sleeve, a lower end of said sleeve connector being formed with an outwardly extending cover shade having an upper end with an inner surface;

a stopper portion on the inner surface of the upper end of said cover shade;

an adjusting ring screwed onto the lower end of said sleeve connector and provided with a plurality of support seats each of which is formed with a slot; and a plurality of support strips each extending through and hanging on one of said slots of said support seats, an upper portion of each of said support strips extending outside said adjusting ring and a lower portion of each of said support strips extending inside said adjusting ring, the upper portion of said support strip abutting against said stopper portion of said sleeve connector whereby, by means of adjusting a height of said adjusting ring on said sleeve connector, lower ends of said support strips are moved inwardly and outwardly to hold various disposable cups having different sizes.

2. A handy adjusting assembly for a disposable cup holder as claimed in claim 1, wherein said support seat of said adjusting ring is formed with a recess and said support strip is formed with a central projecting pin for being hung in said recess, permitting said support strip to rotatably connect with said support seat of said adjusting ring.

3. A handy adjusting assembly for a disposable cup holder as claimed in claim 1, wherein a round abutting block is formed at the lower end of said support strip to hold a disposable cup.

* * * * *